US008387720B1

(12) United States Patent
Keast et al.

(10) Patent No.: US 8,387,720 B1
(45) **Date of Patent: *Mar. 5, 2013**

(54) DRILLING RIG WITH A CONTROL SYSTEM FOR ROTATIONALLY ROCKING A DRILL STRING WITH A TOP DRIVE

(75) Inventors: Larry G. Keast, Houston, TX (US); Stephen Lee Gerhauser, Jr., Houston, TX (US)

(73) Assignee: Larry G. Keast, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/485,584

(22) Filed: May 31, 2012

(51) Int. Cl.
*E21B 44/02* (2006.01)
*E21B 44/04* (2006.01)

(52) U.S. Cl. ..... 175/24; 175/26

(58) Field of Classification Search ..... 175/61, 175/24, 26, 40
See application file for complete search history.

(56) References Cited

U.S. PATENT DOCUMENTS

| | | | | |
|---|---|---|---|---|
| 6,050,348 | A | 4/2000 | Richarson et al. | |
| 6,918,453 | B2 | 7/2005 | Haci et al. | |
| 7,096,979 | B2 | 8/2006 | Haci et al. | |
| 7,152,696 | B2 | 12/2006 | Jones | |
| 7,243,735 | B2 | 7/2007 | Koederitz et al. | |
| 7,810,584 | B2 | 10/2010 | Haci et al. | |
| 2004/0195004 | A1 * | 10/2004 | Power et al. | 175/24 |
| 2006/0081399 | A1 * | 4/2006 | Jones | 175/61 |

* cited by examiner

*Primary Examiner* — Daniel P Stephenson
(74) *Attorney, Agent, or Firm* — Buskop Law Group, PC; Wendy Buskop

(57) ABSTRACT

A drilling rig for automatically executing rocking of a drill string with a moveable top drive using a control system having a processor and data storage connected to a torque pin sensor, a speed sensor; a remote control enabling a user to actuate automatic remote rocking, drilling, orienting and making up of a drill string using the top drive that provides simultaneous right hand and left hand torque applied to the drill string while simultaneously controlling speed of turning of the drill string. A drilling rig for orienting drill pipe, drilling with drill pipe and making up drill pipe into a drill string using the automated control system.

20 Claims, 15 Drawing Sheets

FIGURE 6A

DATA STORAGE (17)

- COMPUTER INSTRUCTIONS TO COMPARE DATA FROM THE TORQUE PIN SENSOR TO USER ESTABLISHED TORQUE MAXIMUMS OR USER ESTABLISHED NUMBERS OF TURNS FOR THE DRILL STRING TO ROCK THE DRILL STRING (70)
- COMPUTER INSTRUCTIONS FOR ESTABLISHING A MAXIMUM TORQUE WHILE DRILLING IN A CLOCKWISE DIRECTION OR A SPECIFIED NUMBER OF TURNS FOR THE DRILL STRING IN A CLOCKWISE DIRECTION (72)
- COMPUTER INSTRUCTIONS FOR ESTABLISHING A MAXIMUM TORQUE WHILE ROTATING THE DRILL STRING IN A COUNTER-CLOCKWISE DIRECTION OR A SPECIFIED NUMBER OF TURNS FOR THE DRILL STRING IN A COUNTER-CLOCKWISE DIRECTION (74)
- COMPUTER INSTRUCTIONS TO OPERATE THE GRABBER TO AUTOMATICALLY CLOSE THE GRABBER, TO GRAB WELLBORE EQUIPMENT OF WELLBORE OPERATIONS; AND TO OPEN THE GRABBER WHEN THE OPEN AND GRAB SWITCH IS ACTUATED FROM THE REMOTE CONTROL (86)
- COMPUTER INSTRUCTIONS FOR AUTOMATICALLY MOVING THE GRABBER UP OR DOWN ALONG THE DRILL STRING USING THE TOP DRIVE, WHEN THE UP AND DOWN SWITCH IS ACTUATED (87)
- COMPUTER INSTRUCTIONS FOR TURNING ON THE GRABBER CLOSED INDICATOR WHEN THE GRABBER IS IN A CLOSED POSITION (88)
- COMPUTER INSTRUCTIONS FOR AUTOMATICALLY FLOATING THE GRABBER WHEN THE GRABBER IS ENGAGED ON THE DRILL STRING (90)
- COMPUTER INSTRUCTIONS FOR AUTOMATICALLY OPENING THE VALVED INSIDE BLOW OUT PREVENTER (IBOP) WITH THE TOP DRIVE; AND FOR AUTOMATICALLY CLOSING THE VALVED INSIDE BLOW OUT PREVENTER (IBOP) WITH THE TOP DRIVE WHEN ACTUATED BY A BLOWOUT PREVENTER OPENING AND CLOSING MEANS (98)
- COMPUTER INSTRUCTIONS FOR PREVENTING THE OPERATION OF THE IBOP IF ANY ROTATION IS DETECTED ON THE DRILL STRING (99)
- COMPUTER INSTRUCTIONS FOR AUTOMATICALLY SETTING THE BRAKE OF THE TOP DRIVE (104)
- COMPUTER INSTRUCTIONS FOR AUTOMATICALLY RELEASING THE BRAKE OF THE TOP DRIVE DEPENDING ON THE COMMANDS FROM THE BRAKE SET AND RELEASE MEANS (106)
- COMPUTER INSTRUCTIONS FOR PROVIDING AN AUTOMATIC EMERGENCY KILL SEQUENCE INCLUDING: STOPPING THE PRIME MOVER; SETTING THE BRAKE OF THE TOP DRIVE; AND LOCKING THE DRILL STRING FROM TURNING (124)
- COMPUTER INSTRUCTIONS PROVIDING AN AUTOMATIC START, RUN, AND KILL SEQUENCE COMPRISING: STARTING THE PRIME MOVER; RUNNING THE PRIME MOVER; KILLING THE PRIME MOVER; SETTING THE BRAKE OF THE TOP DRIVE; AND LOCKING THE DRILL STRING FROM TURNING (126)

FIGURE 6B

17

COMPUTER INSTRUCTIONS TO AUTOMATICALLY SHUT DOWN THE PRIME MOVER AND THE HYDRAULIC PUMPING MEANS ON THE TOP DRIVE, AND TO AUTOMATICALLY ACTUATE THE BRAKE TO STOP THE DRILL STRING FROM TURNING — 134

COMPUTER INSTRUCTIONS FOR TURNING ON THE LOW HYDRAULIC OIL WARNING INDICATOR WHEN THE HYDRAULIC OIL LEVEL SENSOR DETECTS A HYDRAULIC OIL LEVEL BELOW A PRESET LEVEL — 136

COMPUTER INSTRUCTIONS TO AUTOMATICALLY PREVENT THE OPERATION OF THE PRIME MOVER AND OPERATION OF THE HYDRAULIC PUMPING MEANS WHEN THE HYDRAULIC OIL LEVEL SENSOR DETECTS A HYDRAULIC OIL LEVEL BELOW A PRESET LEVEL — 138

COMPUTER INSTRUCTIONS TO ENGAGE THE HYDRAULIC OIL TEMPERATURE WARNING INDICATOR AND LIMIT PRIME MOVER SPEED WHEN THE HYDRAULIC OIL TEMPERATURE EXCEEDS 160 DEGREES FAHRENHEIT — 146

COMPUTER INSTRUCTIONS FOR TURNING ON THE HYDRAULIC OIL TEMPERATURE INDICATOR WHEN THE HYDRAULIC OIL SENSOR DETECTS A HYDRAULIC OIL TEMPERATURE ABOVE PRESET LEVELS IN THE DATA STORAGE — 148

COMPUTER INSTRUCTIONS FOR AUTOMATICALLY ACTIVATING THE HYDRAULIC SHUT DOWN WARNING INDICATOR FOR SHUTTING DOWN OF THE HYDRAULIC PUMPING MEANS AND THE PRIME MOVER AND SETTING THE BRAKE WHEN THE HYDRAULIC OIL TEMPERATURE EXCEEDS A PRESET MAXIMUM OF 170 DEGREES FAHRENHEIT — 150

COMPUTER INSTRUCTIONS TO COMPARE OIL PRESSURES TO PRESET LEVELS AND ACTIVATE THE WARNING INDICATORS WHEN CHARGE OIL PRESSURE IS BELOW A PRESET LIMIT AND THEN (I) AUTOMATICALLY SHUTTING DOWN THE PRIME MOVER, (II) AUTOMATICALLY SHUTTING DOWN THE HYDRAULIC PUMPING MEANS; AND (III) SETTING THE BRAKE STOPPING TURNING OF THE TOP DRIVE WHEN THE CHARGE PRESSURE DROPS BELOW A PRESET LIMIT — 158

COMPUTER INSTRUCTIONS TO COMPARE OIL PRESSURES TO PRESET LEVELS AND ACTIVATE THE WARNING INDICATORS WHEN CHARGE OIL PRESSURE IS BELOW A PRESET LIMIT AND THEN (I) AUTOMATICALLY SHUTTING DOWN THE PRIME MOVER, (II) AUTOMATICALLY SHUTTING DOWN THE HYDRAULIC PUMPING MEANS; AND (III) SETTING THE BRAKE STOPPING TURNING OF THE TOP DRIVE WHEN THE SERVO PRESSURE GOES ABOVE A PRESET LIMIT — 159

COMPUTER INSTRUCTIONS FOR DETECTING COOL OIL FLOW, AND THEN AUTOMATICALLY SHUTTING DOWN A COOL OIL HYDRAULIC PUMPING MEANS AND THE PRIME MOVER WHEN NO COOL OIL FLOW IS DETECTED BY THE COOL OIL CIRCULATION SENSOR THEN AUTOMATICALLY SHUT DOWN THE PRIME MOVER AND SETTING THE BRAKE OF THE TOP DRIVE — 166

COMPUTER INSTRUCTIONS PREVENT THE MODE LIGHTS FROM GLOWING IF A SEQUENCE OF PREDEFINED OPERATIONAL STEPS FOR THE OPERATIONAL HAVE NOT OCCURRED — 168

COMPUTER INSTRUCTIONS INCLUDE COMPUTER INSTRUCTIONS FOR OPERATING THE TOP DRIVE IN DRILLING MODE — 190

COMPUTER INSTRUCTIONS FOR OPERATING THE TOP DRIVE IN ORIENT MODE FOR ORIENTING A DRILL BIT ATTACHED TO A DRILL STRING SUPPORTED BY THE TOP DRIVE — 192

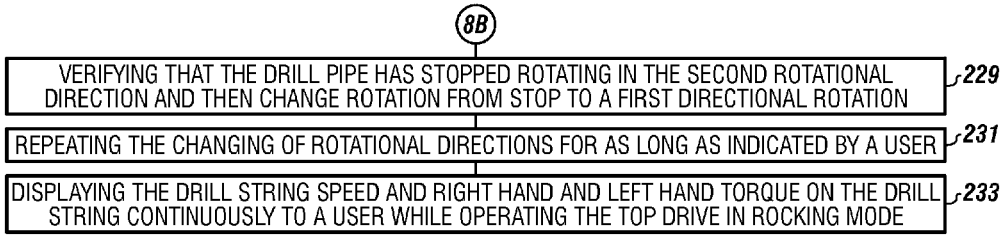
FIGURE 8B
FIGURE 9A
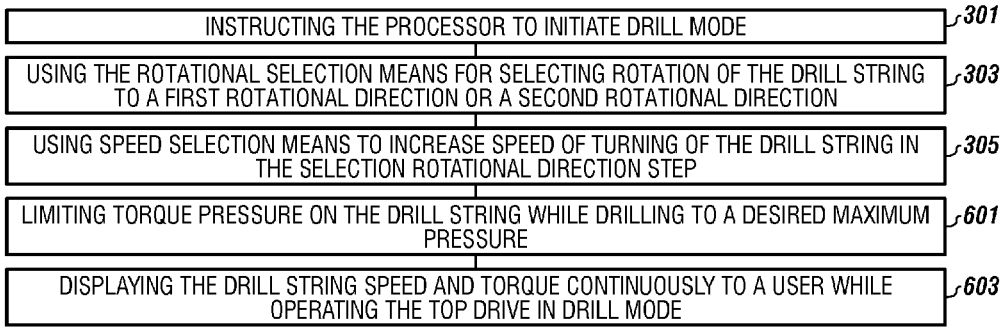

DRILLING RIG WITH A CONTROL SYSTEM FOR ROTATIONALLY ROCKING A DRILL STRING WITH A TOP DRIVE

FIELD

The present embodiments generally relate to a drilling rig with control system that monitors and controls rocking of a drill string using a top drive.

BACKGROUND

A need exists for an improved drilling rig with top drives that can automatically rock the drill string using both right hand torque and left hand torque simultaneously while simultaneously monitoring speed of rotation of the drill string.

A further need exists for a drilling rig with control system that can automatically perform (i) orient, (ii) rock, (iii) drill, and (iv) making-up wellbore operations as well as (v) speed control for turning of a drill string using a remote control operated by a user in a zone of safety.

The present embodiments meet these needs.

BRIEF DESCRIPTION OF THE DRAWINGS

The detailed description will be better understood in conjunction with the accompanying drawings as follows:

FIGS. 6A-6E are a diagram of the data storage of the control system according to one or more embodiments.

FIG. 9A depicts the method wherein the drilling rig can be remotely controlled to drill in a wellbore.

The present embodiments are detailed below with reference to the listed Figures.

DETAILED DESCRIPTION OF THE EMBODIMENTS

Before explaining the apparatus in detail, it is to be understood that the apparatus is not limited to the particular embodiments and that it can be practiced or carried out in various ways.

The present embodiments generally relate to a drilling rig with a top drive control system for rocking a drill string.

The embodiments relate to a drilling rig with top drive control system that can also be used to operate the top drive in drill mode, make-up mode, and orient mode.

Figure 1:
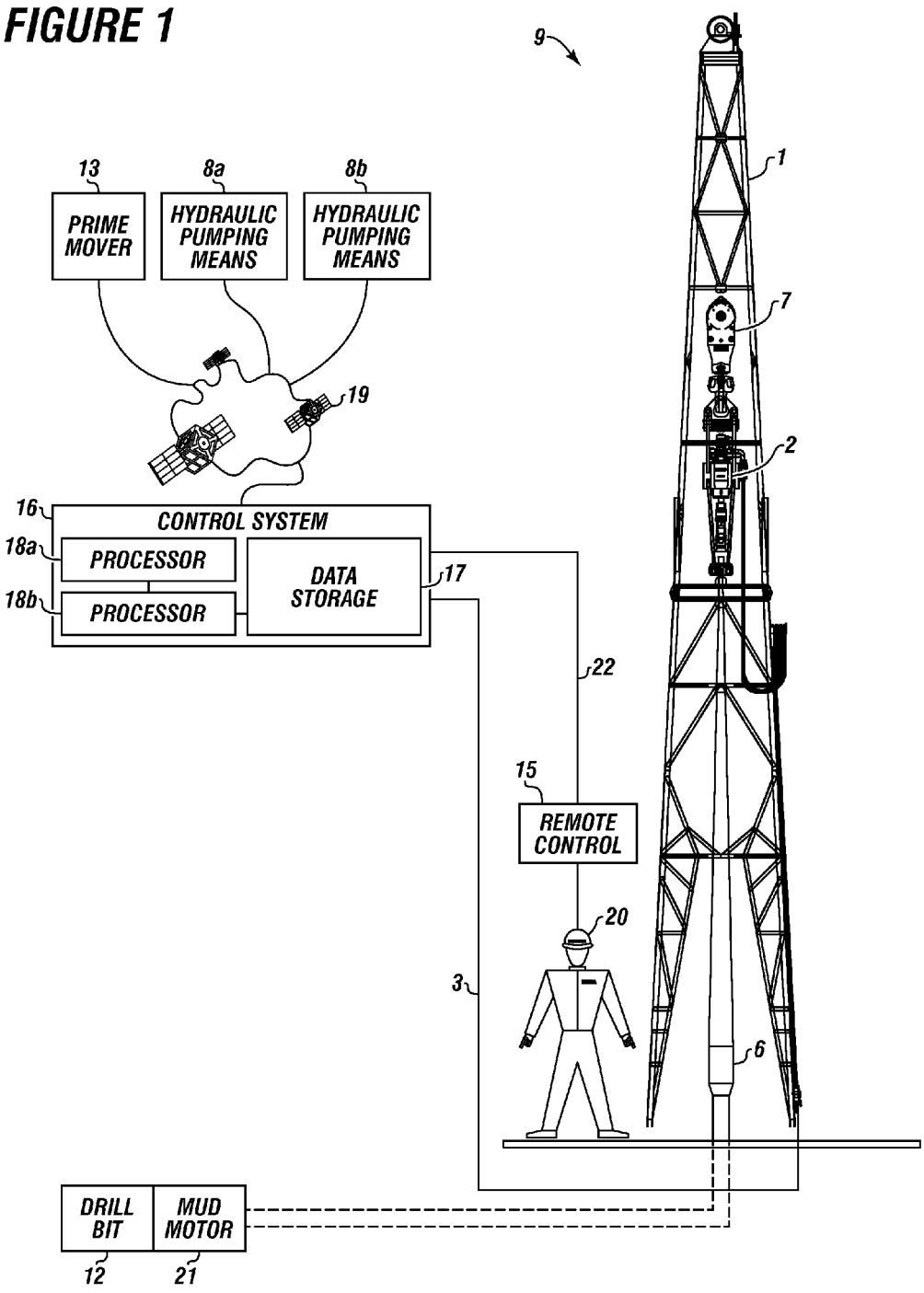
FIG. 1 is a front view of a drilling rig with control system connected thereto according to one or more embodiments.

Turning now to the Figures, FIG. 1 shows a drilling rig with a control system connected thereto according to one or more embodiments.

The drilling rig 9 can have a tower 1, which can support a top drive 2 which in turn can hold a drill string 6. The drilling rig 9 is also shown with a hoist 7 and the top drive 2 mounted to the hoist 7.

The wellbore operations can include a one or two hydraulic pumping means which can be hydraulic pumping means, shown here as hydraulic pumping means 8*a* and 8*b*, which can be controlled simultaneously by the control system 16.

In an embodiment, the control system 16 can allow the hydraulic pumping means 8*a* and 8*b* to act as a single unit, with simultaneous action for double the effective pumping.

The control system 16 can have data storage 17 for storing computer instructions which can be connected to the one or more processors 18*a* and 18*b*. The processors can communicate with a network 19 that in turn can communicate with a prime mover 13. The prime mover 13 can be a diesel engine, an electric motor, or a diesel/electric motor.

A remote control 15 can be connected to the control system 16 and can enable a user 20 to operate the top drive 2 from a remote location while simultaneously monitoring left hand and right hand torque and speed of the drill string in rpm, while turning.

The top drive 2 is shown with a communication umbilical 3 that can connect to the control system 16.

The user 20 is shown proximate to the remote control 15 which can allow the user to control the prime mover 13, hydraulic pumping means 8*a* and 8*b*. A drill bit 12 on the drill string can be run by a mud motor 21.

Also in this Figure, the remote control 15 is shown using a remote control umbilical 22 for operating the various pieces of equipment. A remote control umbilical 22 is shown connecting the remote control 15 to the control system 16.

Figure 2:
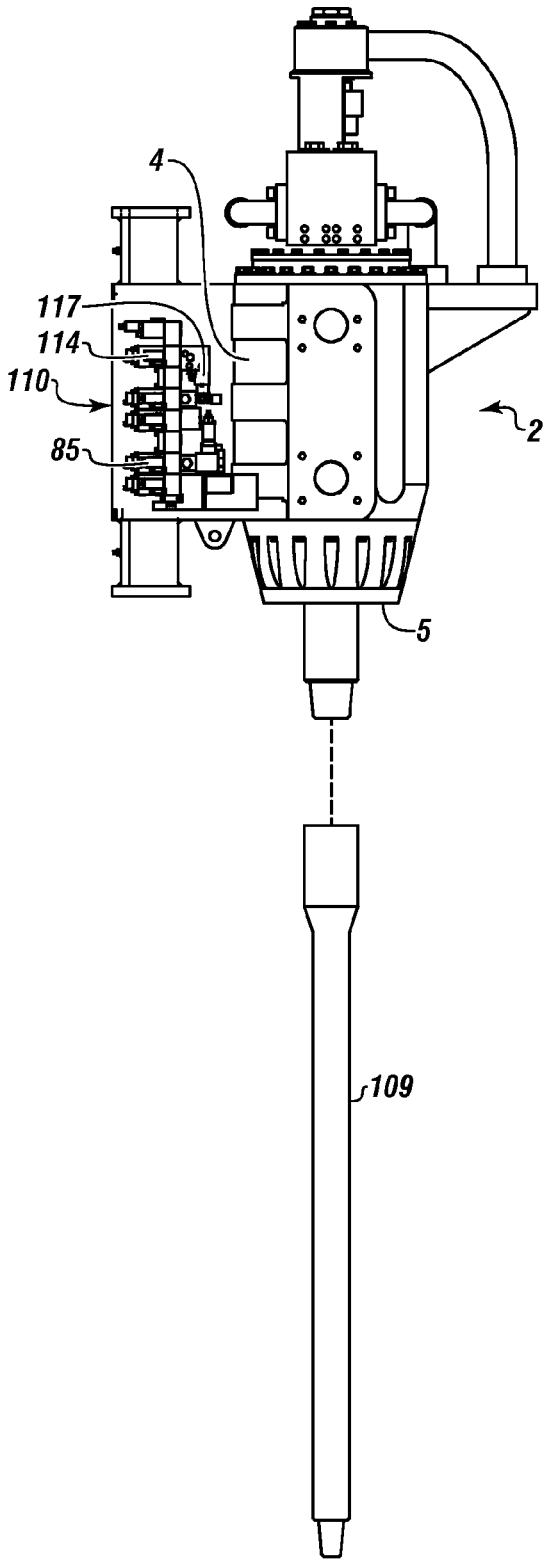
FIG. 2 is a view of a top drive detached from a drill pipe according to one or more embodiments.

FIG. 2 is a view of the top drive 2 detached from a drill pipe 109 according to one or more embodiments.

The top drive 2 is shown having a torque pin sensor 4, and portions of the elevator kick-out 110, namely, the kick-out solenoid 114, and the float solenoid 117.

The elevator portions do not engage the processor in an embodiment of the invention.

Figure 3:
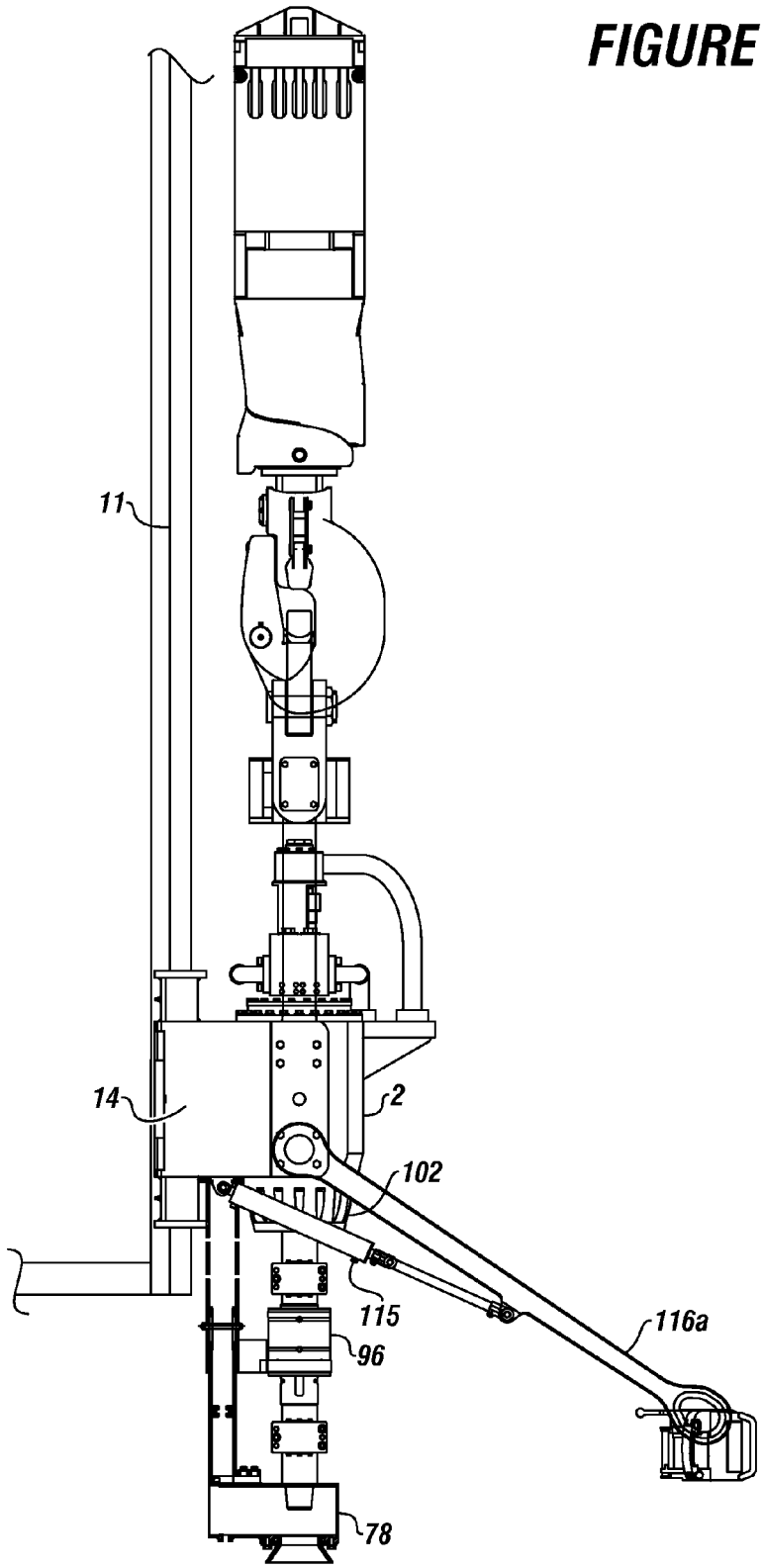
FIG. 3 is a view of a top drive with a torque track slide assembly and elevator kick-out according to one or more embodiments.

Also shown is an up and down hydraulic means 85 for a grabber 78, which is shown in FIG. 3. A speed sensor 5 is also shown and described in detail in FIG. 5.

FIG. 3 is a view of a top drive 2 with a torque track slide assembly 11 and an elevator kick-out according to one or more embodiments.

In this view, the top drive 2 is shown attached to the torque track slide assembly 11. The elevator kick-out link is shown deployed.

The top drive housing 14 is shown to which is installed the kick out. The elevator kick-out 110 as shown in FIG. 2, can engage a first elevator link and a second elevator link. The first elevator link 116*a* is shown in a deployed position.

In an embodiment, a hydraulic cylinder 115 can move at least one of the elevator links or in another embodiments, the hydraulic cylinder 115 can move both elevator links.

A grabber 78 can be deployed between the first and second elevator links.

A valved inside blow out preventer (IBOP) 96 for the wellbore operations can be located between the grabber 78 and the brake 102. An example of a valved inside blow out preventer (IBOP) can be one available from Hi-Kalibre of Edmonton, Canada.

Figure 4:
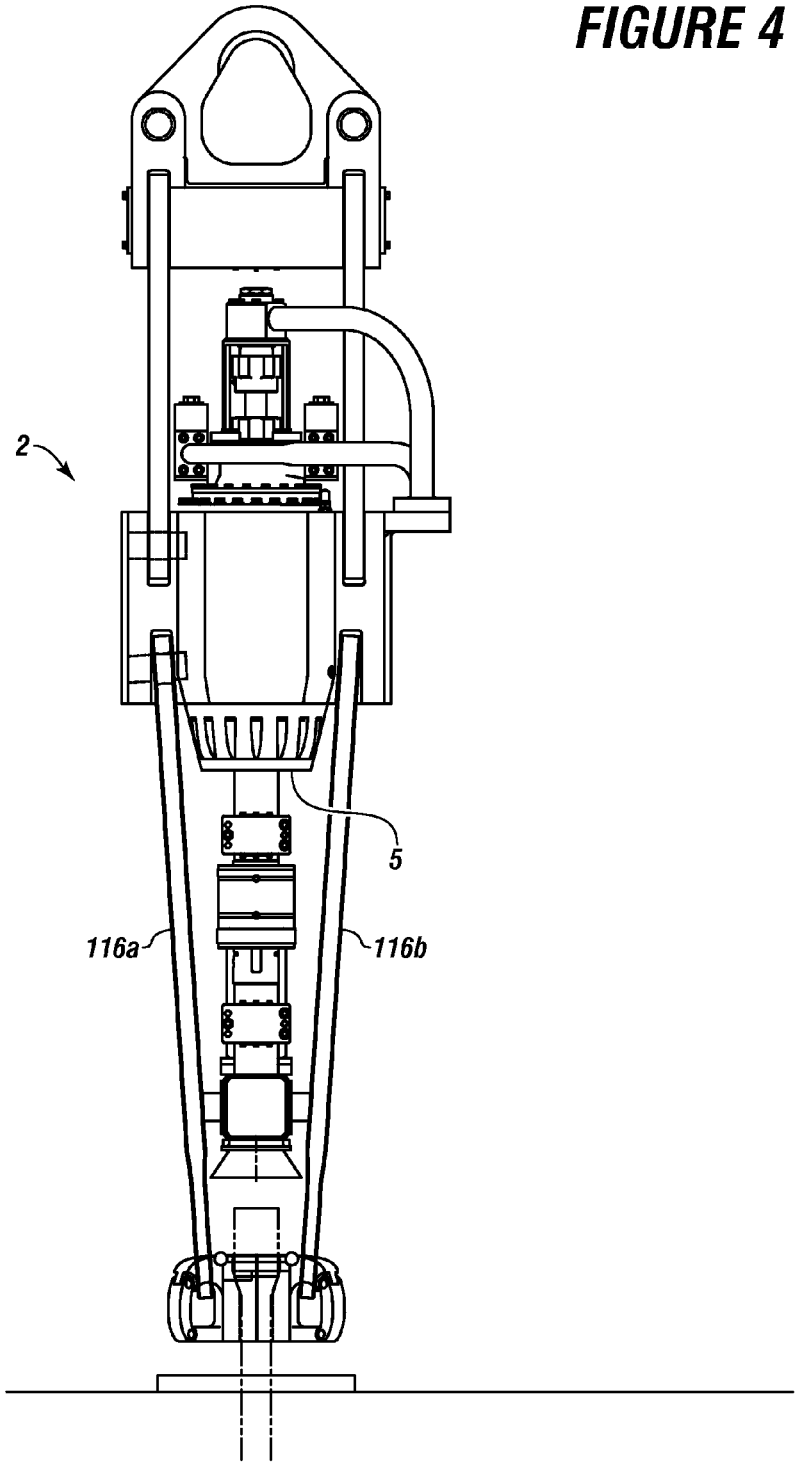
FIG. 4 is a detailed back view of a top drive usable with the drilling rig of FIG. 1.

FIG. 4 shows the speed sensor 5 of the top drive 2 and the first elevator link 116*a* and the second elevator link 116*b* in a neutral position.

Figure 5:
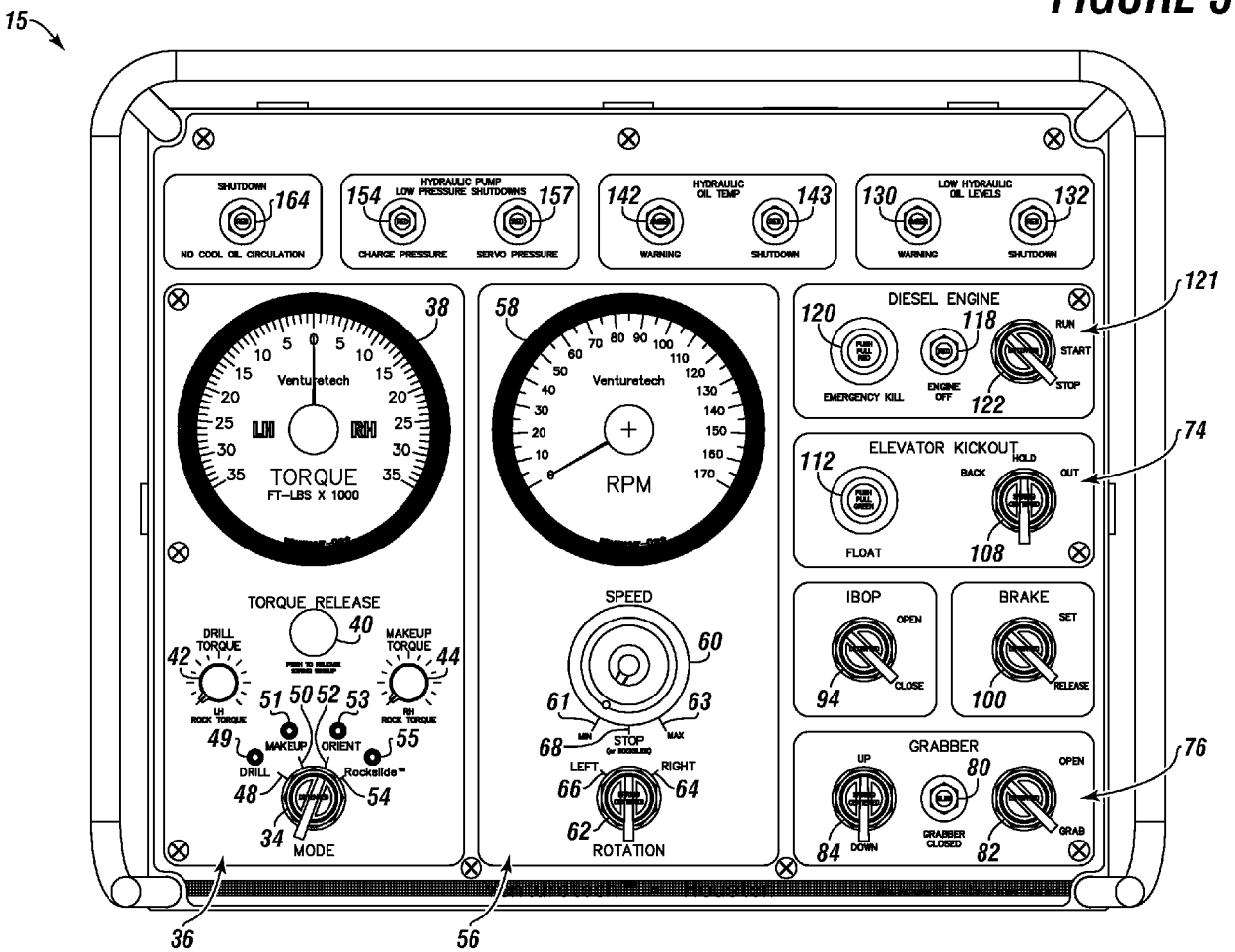
FIG. 5 is a front view of a remote control usable with the control system according to one or more embodiments.
Figure 6C:
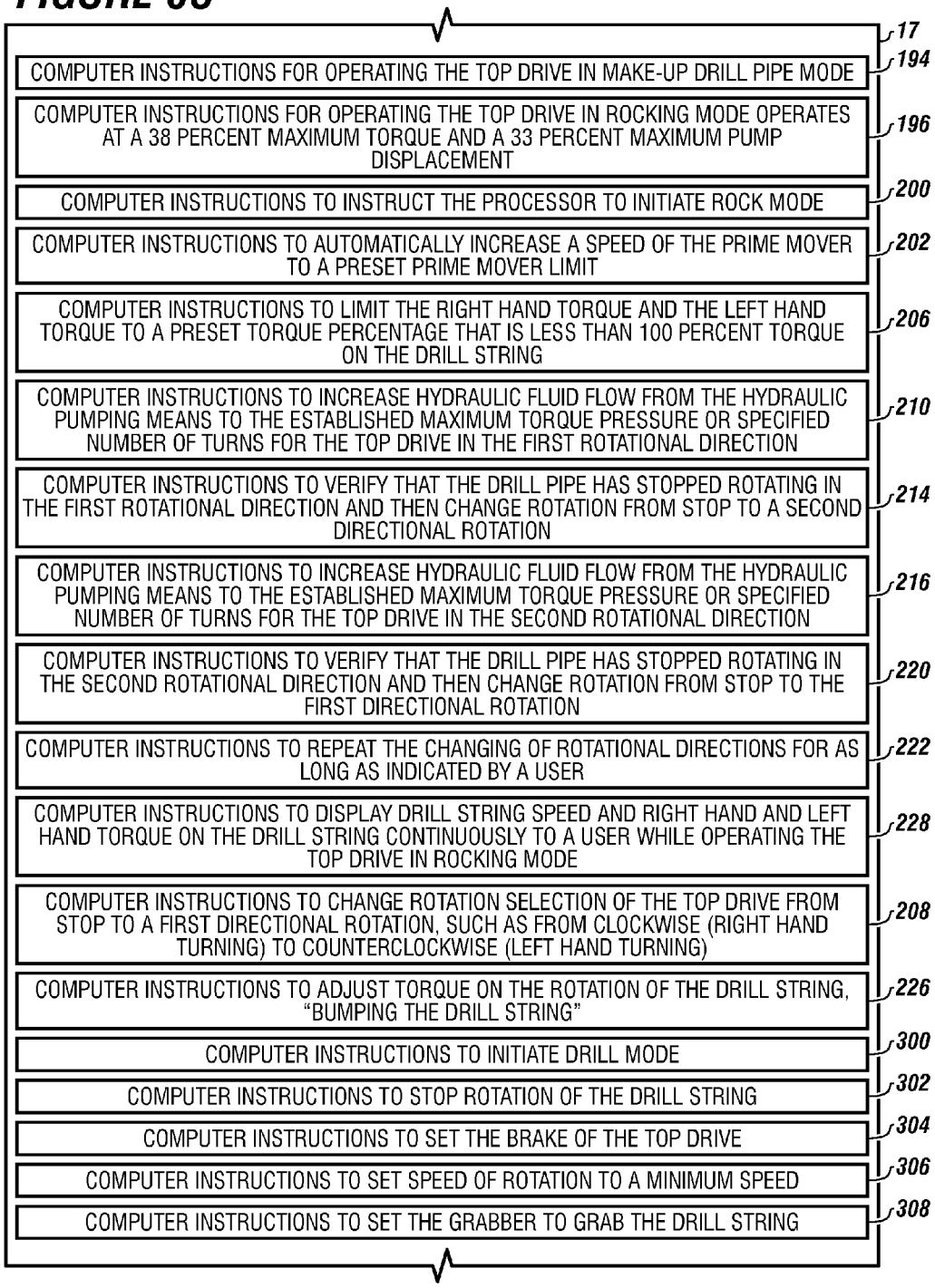
Figure 6D:
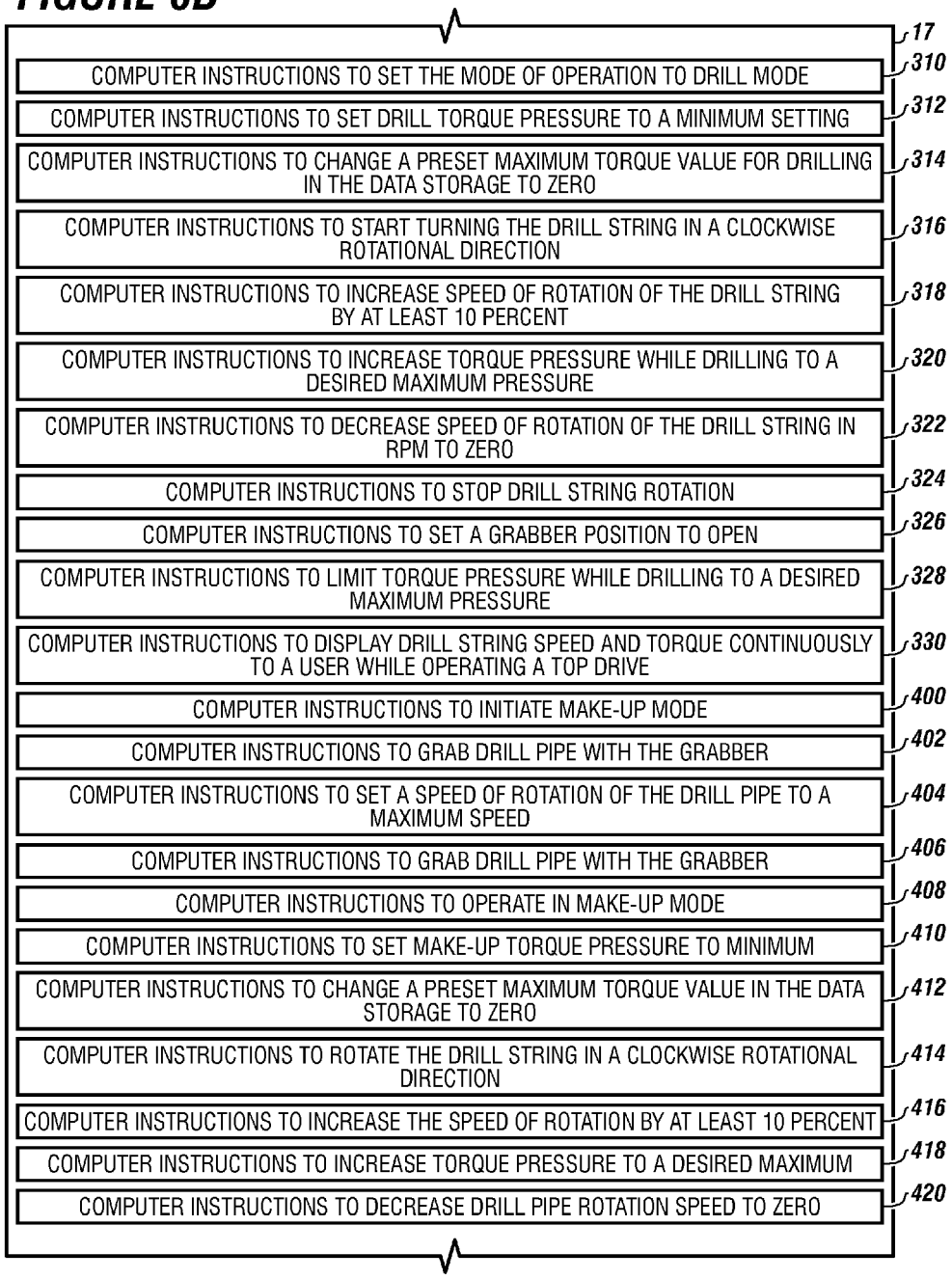
Figure 6E:
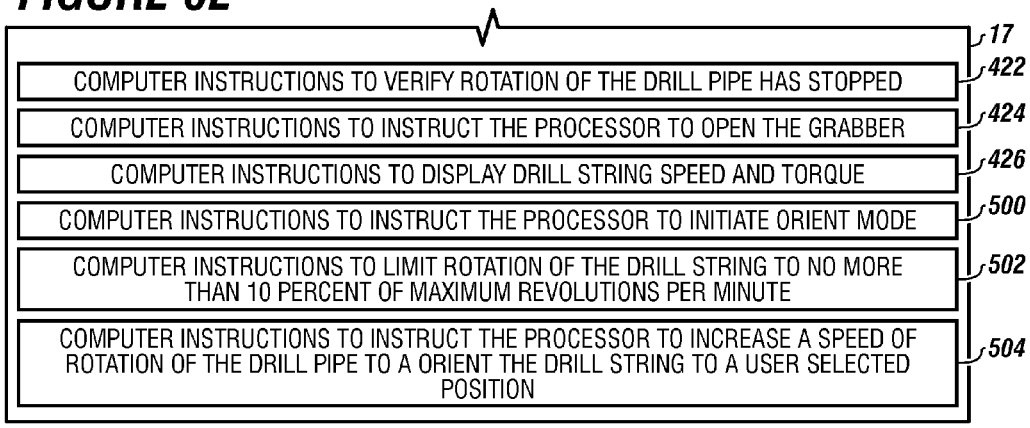

FIG. 5 shows a front view of the remote control 15 according to one or more embodiments.

Torque Control and Monitoring Means

The remote control 15 can have a torque control and monitoring means 36 that can include a right hand and left hand torque display 38 measured in ft-lbs×1000 connected to the processor for displaying simultaneously and in real time right hand and left hand torque being applied to the drill string.

The torque control and monitoring means 36 can have a torque release actuator 40 for releasing drill string wind up. The phrase "releasing drill string wind up" as used herein can mean a controlled way of releasing hydraulic pressure from a high pressure side to a low pressure side of a hydraulic control system.

The torque control and monitoring means 36 can include a drill torque control 42 which can be a potentiometer. The drill torque control 42 can be connected to one or more processors.

In another embodiment the drill torque control 42 can be a touch screen or a similar electronic device, such as a processor with data storage and preset limits that can allow the torque pressure to be increased or decreased.

The torque control and monitoring means 36 can include a make-up torque control 44 which can be a potentiometer. The make-up torque control 44 can be connected to the one or more processors.

In another embodiment the make-up torque control 44 can be a touch screen display or another electronic device, such as a small computer that allows the potential to be increased or decreased.

The torque control and monitoring means 36 can include a mode of operation selection means 34 for the control system.

The mode of operation selection means 34 can include a drill mode 48, a make-up mode 50, an orient mode 52, and a rocking mode 54. The mode of operation selection means 34 depicted in this embodiment can also include a drill mode light 49, a make-up mode light 51, an orient mode light 53, and a rocking mode light 55.

When the mode of operation is selected using the mode of operation selection means 34, the remote control can communicate with computer instructions in the data storage which are detailed in FIGS. 6A-6E.

Speed Control and Monitoring Means

FIG. 5 also depicts a speed control and monitoring means 56 of the remote control.

In this speed control and monitoring means 56, the speed is monitored in real time, 24 hours a day, and 7 days a week, updated to the second.

A speed display 58 depicts the speed of drill pipe rotations in revolutions per minute (rpm) as determined by a speed sensor of the top drive. The speed sensor communicates with the processor for displaying the speed in revolutions per minute of the drill string in real time.

The speed control and monitoring means 56 can include a speed selection means 60, such as a potentiometer connected to the processor. The speed control and monitoring means 56 can include a minimum speed setting 61, as well as a maximum speed setting 63.

Additionally, the speed control and monitoring means 56 can include a rotational selection means 62 for the drill string.

The rotational selection means 62 can be used to select the rotational direction of a drill string. The rotational direction can include clockwise rotation 64, counterclockwise rotation 66; and stop 68.

While the above noted components of the remote control are considered critical to the rocking operation provided by the control system of the top drive, other components can be included on the remote control that relate to additional elements of the drilling rig.

Grabber Control Portion

The remote control 15 can include a grabber control 76 with a grabber closed indicator 80, an open and grab switch 82, and an up and down switch 84.

Valved Inside Blow Out Preventer (IBOP) Control

The remote control 15 can include the valved inside blow out preventer (IBOP) control section having an IBOP open and close switch 94. The IBOP open and close switch 94 can allow the user to select between an open flow path and a closed flow path for the IBOP.

Brake Set and Release Control

The remote control 15 can include a brake set and release means 100 which can be a switch used for communicating with computer instructions in the data storage that automatically set and release the brake.

Elevator Kick-Out Control

In this Figure, the remote control 15 can include an elevator kick-out control means 74 with a float control and indicator 112 and an out, hold, and back switch 108 for the operating the elevator links of the elevator kick-out.

Prime Mover Control

This Figure includes a prime mover control 121. The prime mover control 121 includes a prime mover is off indicator light 118 for indicating when the prime mover is off or "non-operational."

Emergency Kill and Normal On, Run Off Control

The remote control 15 can include an emergency kill control 120 which can be a switch for stopping immediately the operation of the prime mover and the hydraulic pumping means. The remote control can also include a remote start/run means 122 with a start mode, run mode, and a normal kill (stopping) mode.

Low Hydraulic Oil Warning

Figure 7:
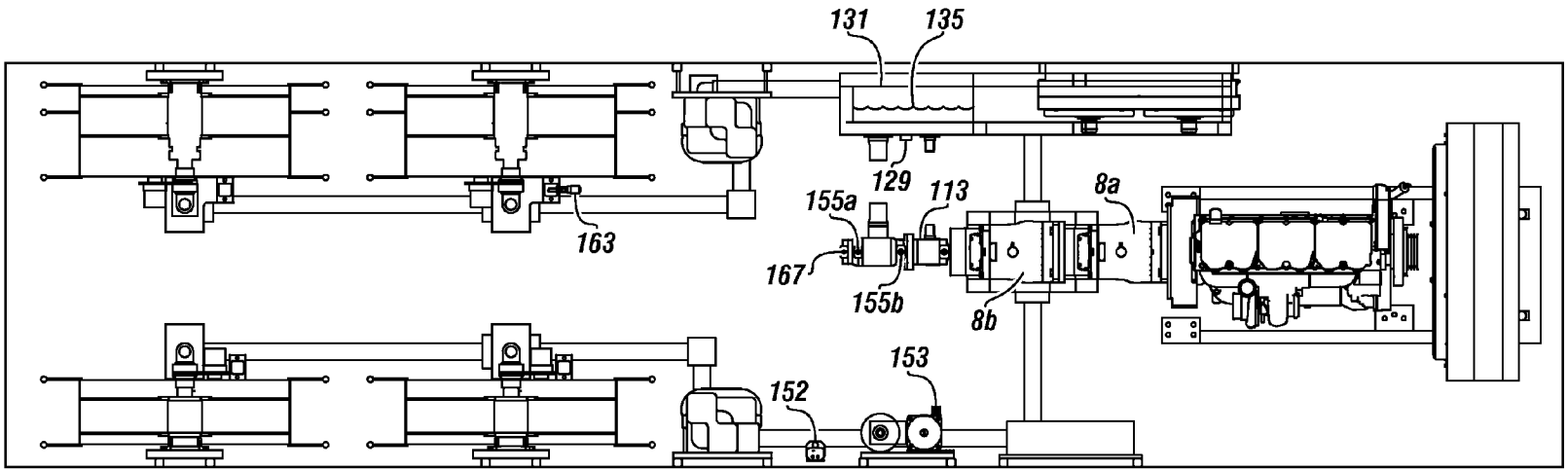
FIG. 7 is a diagram of a detail of the top drive and control system according to one or more embodiments.

A low hydraulic oil warning indicator 130 is shown which indicates a low hydraulic tank level based on at least one hydraulic oil level sensor in a hydraulic tank, which will described in more detail, in FIG. 7.

A low hydraulic oil shutdown indicator 132 is shown for situations when at least one hydraulic oil level sensor provides data, and computer instructions in the data storage are used to compare that data to preset level limits, to determine if the lowest hydraulic tank level is reached. These computer instructions instruct the processor to communicate automatically to the prime mover and hydraulic pumping means to shut down the operation of the prime mover and the operation of the hydraulic pumping means.

Hydraulic Temperature Control

A hydraulic oil temperature shutdown indicator 143 is connected to a hydraulic oil temperature transducer located on the hydraulic pumping means of the drilling rig, which is shown in detail in FIG. 7.

A hydraulic oil temperature shutdown indicator 143 is also connected to computer instructions to automatically shut down the prime mover and the hydraulic pumping means of the top drive when the hydraulic fluid temperature, as the hydraulic fluid flows between the hydraulic pumping means and the hydraulic tank exceeds 170 degrees Fahrenheit. Additionally, the computer instructions set the brake of the top drive after stopping rotation of the drill string.

A hydraulic oil temperature warning indicator 142 can connect to the processor and at least one hydraulic oil temperature sensor, located on the hydraulic pumping means of the drilling rig, seen in FIG. 7.

The hydraulic oil temperature warning indicator 142 connects to computer instructions to automatically limit the operation of the prime mover and operation of the hydraulic pumping means when the hydraulic oil temperature sensor detects a hydraulic oil temperature above a preset level, and sets the brake of the top drive.

It should also be noted that the hydraulic oil temperature sensor not only detects a hydraulic oil temperature but connects to the processor allowing the processor to compare the sensed temperature to preset levels in the data storage. If the temperature exceeds preset limits, the computer instructions are used to reduce the revolutions per minute (rpm) of the prime mover and the top drive to a preset minimum while maintaining the prime mover and top drive rpm at a lower level until the temperature of the hydraulic oil cools off. In another embodiment, the computer instructions will shut off the prime mover to protect the hydraulic pumping means from overheating.

A hydraulic oil low pressure warning indicator 154 communicates with a charge pressure sensor located in a pressurized hydraulic charge line for the hydraulic pumping means, which is also shown in FIG. 7.

The hydraulic oil low pressure warning indicator 154 operates with computer instructions to automatically shut down the prime mover and the hydraulic pumping means when the charge pressure drops below a preset limit, and additionally automatically sets the brake when the rotation of the top drive stops.

Another hydraulic oil low pressure warning indicator 157 communicates with the servo pressure sensor located in a servo control line for the hydraulic pumping means.

The hydraulic oil low pressure warning indicator 157 operates with computer instructions to automatically shut down the prime mover and the hydraulic pumping means when the servo pressure drops below a preset limit and sets the brake of the top drive.

Embodiments of the remote control can have a no cool oil circulation indicator 164 connected to the processor and to the cool oil circulation sensor to operate with computer instructions to automatically shut down the prime mover and hydraulic pumping means when no cool oil is circulating by calculating circulation rates and comparing the calculated rates to preset limits in the data storage. The computer instructions also automatically set the brake of the top drive once rotation has stopped.

As used herein, the term "predefined operational steps" for actuating the mode lights of the mode selecting switch can refer to the steps performed by the processor using computer instructions in the data storage for all modes, drilling with the drill string, orienting with the drill string, rocking with the drill string and making-up drill pipe into a drill string or breaking up drill pipe that forms the drill string.

The control system can also be used in an embodiment, to set torque for the make-up mode, and setting torque for the drilling mode.

FIGS. 6A-6E represent the data storage which contains various computer instructions for instructing the processor to perform various tasks by the control system for drilling rig with top drive and can communicate with the remote control.

The data storage 17 can include computer instructions to compare data from the torque pin sensor to user established torque maximums or user established numbers of turns for the drill string to rock the drill string 70.

The data storage 17 can include computer instructions for establishing a maximum torque while drilling in a clockwise direction or a specified number of turns for the drill string in a clockwise direction 72; and computer instructions for establishing a maximum torque while rotating the drill string in a counter-clockwise direction or a specified number of turns for the drill string in a counter-clockwise direction 74.

The data storage 17 can include computer instructions to operate the grabber to automatically close the grabber to grab wellbore equipment of wellbore operations; and to open the grabber when the open and grab switch is actuated from the remote control 86.

The data storage 17 can include computer instructions for automatically moving the grabber up or down along the drill string using the top drive, when the up and down switch is actuated 87; and computer instructions for turning on the grabber closed indicator when the grabber is in a closed position 88.

The data storage 17 can include computer instructions for automatically floating the grabber when the grabber is engaged on the drill string 90.

The data storage 17 can include computer instructions for automatically opening the valved inside blow out preventer (IBOP) with the top drive; and for automatically closing the valved inside blow out preventer (IBOP) with the top drive when actuated by a blowout preventer opening and closing means 98.

The data storage 17 includes computer instructions in the data storage for preventing the operation of the IBOP if any rotation is detected on the drill string 99.

The data storage 17 can include computer instructions for automatically setting the brake of the top drive 104; and computer instructions in the data storage for automatically releasing the brake of the top drive depending on the commands from the brake set and release means 106.

The data storage 17 can include computer instructions for providing an automatic emergency kill sequence including: stopping the prime mover; setting the brake of the top drive; and locking the drill string from turning 124.

The data storage 17 can include computer instructions providing an automatic start, run, and kill sequence comprising: starting the prime mover; running the prime mover; killing the prime mover; setting the brake of the top drive; and locking the drill string from turning 126.

The data storage 17 can include computer instructions to automatically shut down the prime mover and the hydraulic pumping means on the top drive, and to automatically actuate the brake to stop the drill string from turning 134; as well as computer instructions for turning on the low hydraulic oil warning indicator when the hydraulic oil level sensor detects a hydraulic oil level below a preset level 136.

The data storage 17 can include computer instructions to automatically prevent the operation of the prime mover and operation of the hydraulic pumping means when the hydraulic oil level sensor detects a hydraulic oil level below a preset level 138.

The data storage 17 can include computer instructions to engage the hydraulic oil temperature warning indicator and limit prime mover speed when the hydraulic oil temperature exceeds 160 degrees Fahrenheit 146.

The data storage 17 can include computer instructions for automatically activating the hydraulic shut down warning indicator for shutting down of the hydraulic pumping means and the prime mover and setting the brake when the hydraulic oil temperature exceeds a preset maximum of 170 degrees Fahrenheit 150.

The data storage 17 can include computer instructions to compare oil pressures to preset levels and activate the warning indicators when charge oil pressure is below a preset limit and then (i) automatically shutting down the prime mover, (ii) automatically shutting down the hydraulic pumping means; and (iii) setting the brake stopping turning of the top drive when the charge pressure drops below a preset limit 158.

The data storage 17 can include computer instructions to compare oil pressures to preset levels and activate the warning indicators when charge oil pressure is below a preset limit and then (i) automatically shutting down the prime mover, (ii) automatically shutting down the hydraulic pumping means; and (iii) setting the brake stopping turning of the top drive when the servo pressure goes above a preset limit 159.

The data storage 17 can include computer instructions for detecting cool oil flow, and then automatically shutting down the hydraulic pumping means and the prime mover when no cool oil flow is detected by the cool oil circulation sensor then automatically shut down the prime mover and setting the brake of the top drive 166.

The data storage 17 can include computer instructions to prevent the mode lights from glowing if a sequence of predefined operational steps has not occurred 168.

The data storage can include computer instructions for operating the top drive in drilling mode 190, wherein the top drive operates at a 100 percent maximum drill torque and an 80 percent maximum hydraulic pumping means displacement.

The data storage can include computer instructions for operating the top drive in orient mode for orienting a drill bit attached to a drill string supported by the top drive 192.

The data storage 17 can include computer instructions for the top drive in make-up drill pipe mode 194, wherein the top drive operates at a 100 percent maximum make-up torque and a 33 percent maximum hydraulic pumping means displacement.

The data storage 17 can include computer instructions that the control system can use to perform other operations besides rocking.

The data storage 17 can include computer instructions for operating the top drive in rocking mode operates at a 38 percent maximum torque and a 33 percent maximum pump displacement 196.

The data storage 17 can include computer instructions to instruct the processor to initiate rock mode 200.

The data storage 17 can include computer instructions to automatically increase a speed of the prime mover to a preset prime mover limit 202.

The data storage can include the following computer instructions to be used with a method for at least partially rocking the drill string.

The data storage 17 can include computer instructions to limit the right hand torque and the left hand torque to a preset torque percentage that is less than 100 percent torque on the drill string 206.

The data storage 17 can include computer instructions to increase hydraulic fluid flow from the hydraulic pumping means to the established maximum torque pressure or specified number of turns for the top drive in the first rotational direction 210.

The data storage 17 can include computer instructions to verify that the drill pipe has stopped rotating in the first rotational direction and then change rotation from stop to a second directional rotation 214.

The data storage 17 can include computer instructions to increase hydraulic fluid flow from the hydraulic pumps means to the established maximum torque pressure or specified number of turns for the top drive in the second rotational direction 216.

The data storage 17 can include computer instructions to verify that the drill pipe has stopped rotating in the second rotational direction and then change rotation from stop to the first directional rotation 220.

The data storage 17 can include computer instructions to repeat the changing of rotational directions for as long as indicated by a user 222.

The data storage 17 can include computer instructions to adjust speed of the drill string while verifying that the drill pipe has stopped rotating in the second rotational direction and then change rotation from stop to the first directional rotation for as long as indicated by a user 224.

The data storage 17 can include computer instructions to display drill string speed and right hand and left hand torque on the drill string continuously to a user while operating the top drive in rocking mode 228.

The data storage can also be configured to contain many other computer instructions that the control system can use to perform other operations.

The data storage 17 can include computer instructions to change rotation selection of the top drive from stop to a first directional rotation, such as from clockwise (right hand turning) to counterclockwise (left hand turning) 208.

The data storage 17 can include computer instructions 226 to adjust torque on the rotation of the drill string, "bumping the drill string", while verifying that the drill pipe has stopped rotating in the second rotational direction and then change rotation from stop to the first directional rotation for as long as indicated by a user.

The data storage 17 can include computer instructions to initiate drill mode 300.

The data storage 17 can include computer instructions to stop rotation of the drill string 302.

The data storage 17 can include computer instructions to release the brake of the top drive 304.

The data storage 17 can include computer instructions to set speed of rotation to a minimum speed 306.

The data storage 17 can include computer instructions to set the grabber to grab the drill string 308.

The data storage 17 can include computer instructions to set the mode of operation to drill mode 310.

The data storage 17 can include computer instructions 312 to set drill torque pressure to a minimum setting 312.

The data storage 17 can include computer instructions to change a preset maximum torque value for drilling in the data storage to zero 314.

The data storage 17 can include computer instructions to start turning the drill string in a clockwise rotational direction 316.

The data storage 17 can include computer instructions to increase speed of rotation of the drill string by at least 10 percent 318.

The data storage 17 can include computer instructions to increase torque pressure while drilling to a desired maximum pressure 320.

The data storage 17 can include computer instructions to decrease speed of rotation of the drill string in rpm to zero 322.

The data storage 17 can include computer instructions to stop drill string rotation 324.

The data storage 17 can include computer instructions to set a grabber position to open 326.

The data storage 17 can include computer instructions to limit torque pressure while drilling to a desired maximum pressure 328.

The data storage 17 can include computer instructions to display drill string speed and torque continuously to a user while operating a top drive 330.

The data storage 17 can include computer instructions to initiate make-up mode 400.

The data storage 17 can include computer instructions to grab drill pipe with the grabber 402.

The data storage 17 can include computer instructions to set a speed of rotation of the drill pipe to a maximum speed 404.

The data storage 17 can include computer instructions to grab drill pipe with the grabber 406.

The data storage 17 can include computer instructions to operate in make-up mode 408.

The data storage 17 can include computer instructions to set make-up torque pressure to minimum 410.

The data storage 17 can include computer instructions to change a preset maximum torque value in the data storage to zero 412.

The data storage 17 can include computer instructions to rotate the drill string in a clockwise rotational direction 414.

The data storage 17 can include computer instructions to increase the speed of rotation by at least 10 percent 416.

The data storage 17 can include computer instructions to increase torque pressure to a desired maximum 418.

The data storage 17 can include computer instructions to decrease drill pipe rotation speed to zero 420.

The data storage 17 can include computer instructions to verify rotation of the drill pipe has stopped 422.

The data storage 17 can include computer instructions to instruct the processor to open the grabber 424.

The data storage 17 can include computer instructions to instruct the processor to initiate orient mode 500.

The data storage 17 can include computer instructions to limit rotation of the drill string to no more than 10 percent of maximum revolutions per minute 502.

The data storage 17 can include computer instructions to instruct the processor to increase a speed of rotation of the drill pipe to orient the drill string to a user selected position 504.

Additional features of the invention relate to oil level monitoring and alarms and oil temperature monitoring and alarms, and oil pressure monitoring and alarms. Reference in part to FIG. 7 will assist in understanding these features. FIG. 7 is a detail of the top drive equipment. The equipment includes a hydraulic tank 131 for holding hydraulic fluid 135.

Oil Level Monitoring and Alarm

One or more hydraulic oil level sensors can be used for the oil level monitoring and alarm feature of the embodiments. A hydraulic oil level sensor 129 which can detect a hydraulic oil level in the hydraulic tank 131. The hydraulic oil level sensor 129 conveys data to computer instructions in the data storage. The computer instructions can compare the sensed data to preset level data in the data storage and then provide a notification when the hydraulic oil level is below a preset level.

Oil Temperature Monitoring and Alarm

A hydraulic oil temperature sensor 113 can detect temperature of hydraulic oil in the hydraulic oil flow lines, including detecting temperature between the hydraulic tank 131 and the hydraulic pumping means 8*a* and 8*b*.

Oil Pressure Monitoring and Charging

FIG. 7 shows two automatically operable pumping means 155*a* and 155*b* for building hydraulic oil pressure to the hydraulic pumping means 8*a* and 8*b*, allowing the hydraulic oil to automatically charge the hydraulic pumping means when a charge pressure sensor 153 and a servo pressure sensor 152 are used with computer instructions to detect pressure below a preset limit.

The hydraulic oil low pressure warning indicator on the remote control that communicates with the charge pressure sensor 153, located in a pressurized hydraulic charge line for the hydraulic pumping means 8*a* and 8*b*.

No Flow Monitor and Alarm

Also shown in FIG. 7 is a cool oil circulation sensor 163 that connects with the cool oil pump means 167. The cool oil circulation sensor 163 actuates an indicator when no oil flow is detected. The indicator is on the remote control.

Rocking

Figure 8A:
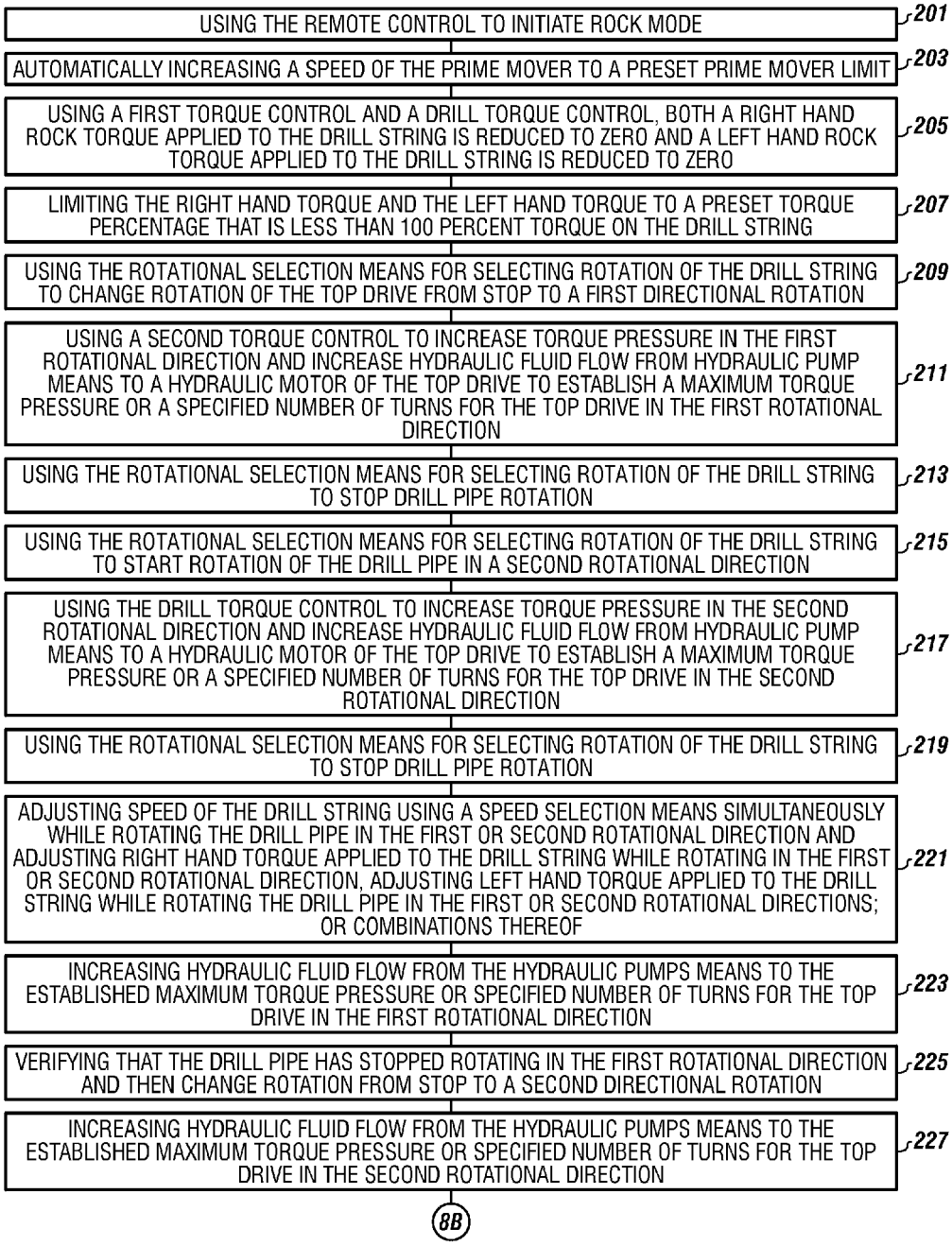
FIG. 8 is a diagram of a sequence of steps wherein the drilling rig can automatically control rocking of drill pipe.

FIGS. 8A and 8B depict a method for rocking the drill string by the drilling rig using the control system of the top drive.

In one or more embodiments, the user can use the remote control to actuate computer instructions in the data storage of the control system of the top drive.

The method can include using the remote control to initiate rock mode 201.

The method can include automatically increase a speed of the prime mover to a preset prime mover limit, such as 1800 rpm 203.

The method can include using a first torque control and a drill torque control, both a right hand rock torque applied to the drill string is reduced to zero and a left hand rock torque applied to the drill string is reduced to zero 205.

The method can include using computer instructions to limit the right hand torque and the left hand torque to a preset torque percentage that is less than 100 percent torque on the drill string 207.

The method can include using the rotational selection means for selecting rotation of the drill string to change rotation of the top drive from stop to a first directional rotation 209.

The method can include using a second torque control to increase torque pressure in the first rotational direction and increase hydraulic fluid flow from hydraulic pump means to a hydraulic motor of the top drive to establish a maximum torque pressure or a specified number of turns for the top drive in the first rotational direction 211.

The method can include using the rotational selection means for selecting rotation of the drill string to stop drill pipe rotation 213.

The method can include using the rotational selection means for selecting rotation of the drill string to start rotation of the drill pipe in a second rotational direction 215.

The method can include using a second torque control to increase torque pressure in the second rotational direction and increase hydraulic fluid flow from hydraulic pumping means to a hydraulic motor of the top drive to establish a maximum torque pressure or a specified number of turns for the top drive in the second rotational direction 217.

The method can include using the rotational selection means for selecting rotation of the drill string to stop drill pipe rotation 219.

The method can include adjusting speed of the drill string using a speed selection means simultaneously while rotating the drill pipe in the first or second rotational direction and adjusting right hand torque applied to the drill string while rotating in the first or second rotational direction, adjusting left hand torque applied to the drill string while rotating the drill pipe in the first or second rotational directions; or combinations thereof 221.

The method can include increasing hydraulic fluid flow from the hydraulic pumps means to the established maximum torque pressure or specified number of turns for the top drive in the first rotational direction 223.

The method can include verifying that the drill pipe has stopped rotating in the first rotational direction and then change rotation from stop to a second directional rotation 225.

The method can include increasing the hydraulic fluid flow from the hydraulic pumps means to the established maximum torque pressure or specified number of turns for the top drive in the second rotational direction 227.

FIG. 8B is a continuation of the method steps of FIG. 8A.

The method can include verifying that the drill pipe has stopped rotating in the second rotational direction and then change rotation from stop to the first directional rotation 229.

The method can include repeating the changing of rotational directions for as long as indicated by a user 231.

The method can include displaying the drill string speed and right hand and left hand torque on the drill string continuously to a user while operating the top drive in rocking mode 233.

Drilling

FIG. 9A depicts the computer implemented method wherein the drilling rig can be remotely controlled to drill in a wellbore.

The method can include instructing the processor to initiate drill mode 301.

The method can involve using the rotational selection means for selecting rotation of the drill string to a first rotational direction or a second rotational direction 303.

The method can include using speed selection means to increase speed of turning of the drill string in the selection rotational direction step 305.

The method can include limiting torque pressure on the drill string while drilling to a desired maximum pressure 601.

The method can include displaying the drill string speed and torque continuously to a user while operating the top drive in drill mode 603.

Setting Torque for Drilling

Figure 9B:
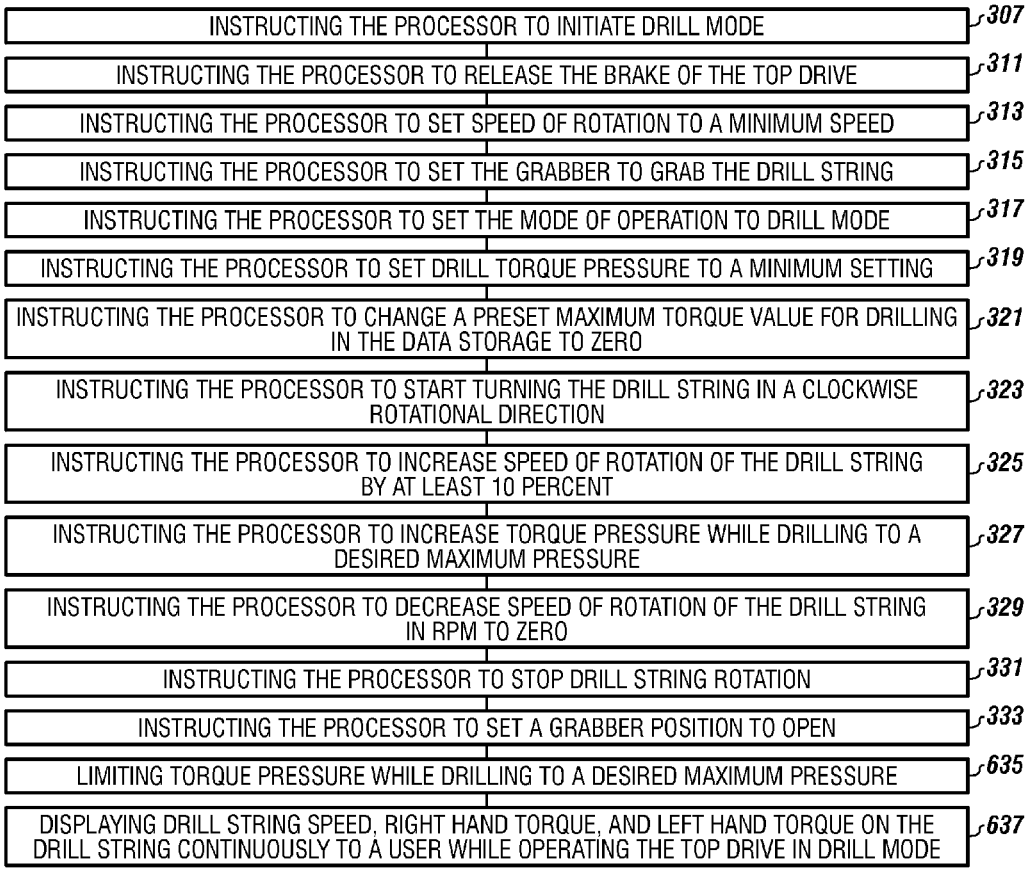
FIG. 9B depicts the steps wherein the torque settings can be set up to allow for the automated drilling of a wellbore.

FIG. 9B depicts a method to set torque for drilling with the top drive.

The computer implemented method for setting torque of a top drive with a brake of drilling rig having a grabber, a top drive control system with a processor, computer instructions in the data storage, and a remote control for operating the top drive while setting torque or while drilling.

The method can include instructing the processor to initiate drill mode 307.

The method can include instructing the processor to release the brake of the top drive 311.

The method can include instructing the processor to set speed of rotation to a minimum speed 313.

The method can include instructing the processor to set the grabber to grab the drill string 315.

The method can include instructing the processor to set the mode of operation to drill mode 317.

The method can include instructing the processor to set drill torque pressure to a minimum setting 319.

The method can include instructing the processor to change a preset maximum torque value for drilling in the data storage to zero 321.

The method can include instructing the processor to start turning the drill string in a clockwise rotational direction 323.

The method can include instructing the processor to increase speed of rotation of the drill string by at least 10 percent 325.

The method can include instructing the processor to increase torque pressure while drilling to a desired maximum pressure 327.

The method can include instructing the processor to decrease speed of rotation of the drill string in rpm to zero 329.

The method can include instructing the processor to stop drill string rotation 331.

The method can include instructing the processor to set a grabber position to open 333.

The method can include limiting torque pressure while drilling to a desired maximum pressure 635.

The method can include displaying drill string speed, right hand torque, and left hand torque on the drill string continuously to a user while operating the top drive in drill mode 637.

Making-Up

Figure 10A:
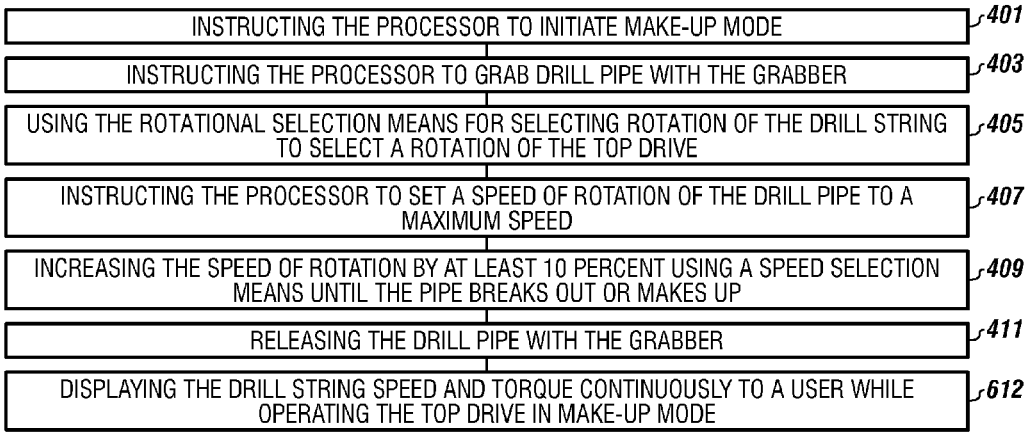
FIG. 10A shows the steps wherein the drilling rig can be remotely controlled to automatically drill.

FIG. 10A shows the steps wherein the drilling rig can be remotely controlled to make-up drill pipe.

The method for rotating a drill string for making-up drill pipe using a drilling rig with grabber, a top drive with a brake, and a control system with a processor, data storage and a remote control.

The method can include instructing the processor to initiate make-up mode, as illustrated by box 401.

The method can include instructing the processor to grab drill pipe with the grabber, as illustrated by box 403.

The method can include using the rotational selection means for selecting rotation of the drill string to select a rotation of the top drive as illustrated by box 405.

The method can include instructing the processor to set a speed of rotation of the drill pipe to a maximum speed, as illustrated by box 407.

The method can include increasing the speed of rotation by at least 10 percent using a speed selection means until the pipe breaks-out or makes-up, as illustrated by box 409.

The method can include releasing the drill pipe with the grabber, as illustrated by box 411.

The method can include displaying the drill string speed and torque continuously to a user while operating the top drive in make-up mode, as illustrated by box 612.

Figure 10B:
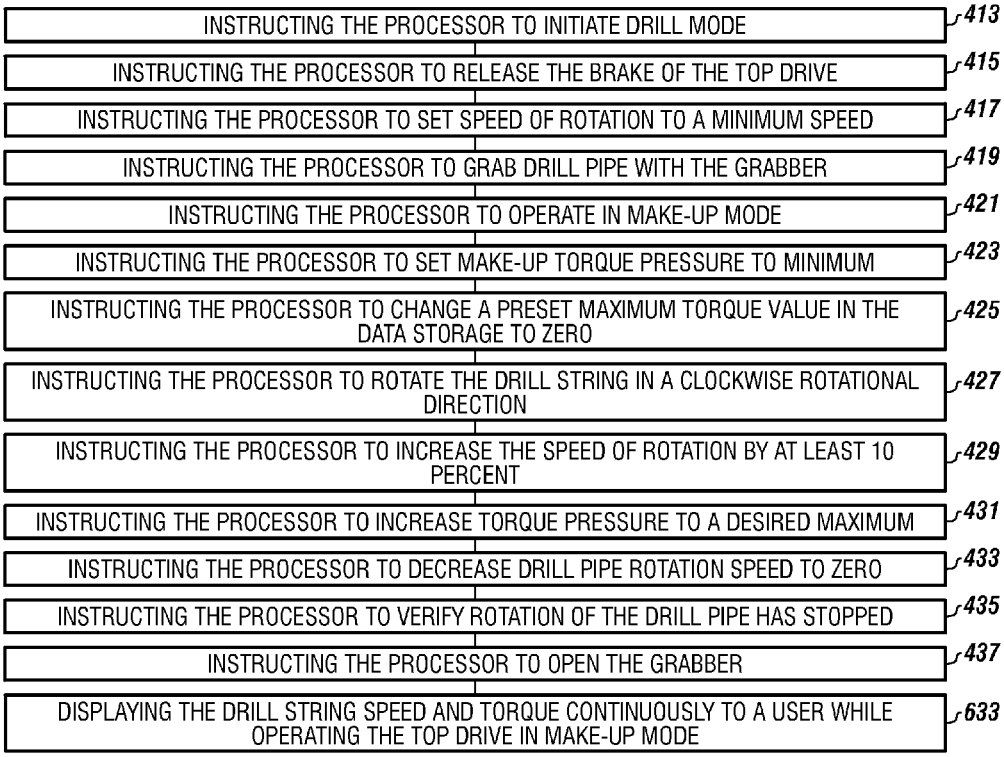
FIG. 10B shows an automatic method of make-up operations.

FIG. 10B shows an automatic method of make-up operations.

The method can include instructing the processor to initiate drill mode, at box 413.

The method can include instructing the processor to release the brake of the top drive, at box 415.

The method can also include instructing the processor to set speed of rotation to a minimum speed, at box 417.

The method can also include instructing the processor to grab drill pipe with the grabber, at box 419.

At box 421, the method continues by instructing the processor to operate in make-up mode.

Then at box 423 the method include instructing the processor to set make-up torque pressure to a minimum.

The method can also include instructing the processor to change a preset maximum torque value in the data storage to zero, at box 425.

The method continues at box 427 by instructing the processor to rotate the drill string in a clockwise rotational direction.

The method can also include instructing the processor to increase torque pressure to a desired maximum, at box 431.

At box 433, the method can include instructing the processor to decrease drill pipe rotation speed to zero.

At box 435, the method can include instructing the processor to verify rotation of the drill pipe had stopped.

The method can also include instructing the processor to open the grabber, at box 437.

The method can also include displaying the drill string speed and torque continuously to user while operating the top drive in make-up mode, at box 633.

Orienting

Figure 11:
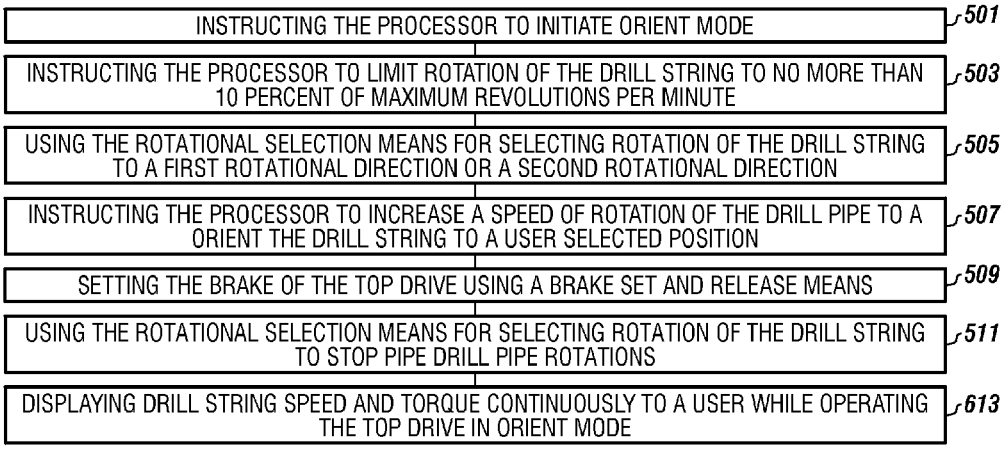
FIG. 11 shows the steps wherein the drilling rig can be remotely controlled to make-up drill pipe.

FIG. 11 shows the method wherein the drilling rig can be remotely controlled to orient drill pipe using the remote control.

The method can involve instructing the processor to initiate orient mode, as illustrated by box 501.

The method can include instructing the process to limit the rotation of the drill string to no more than 10 percent of maximum revolutions per minute of the top drive, as illustrated by box 503.

The method can involve using the rotational selection means for selecting rotation of the drill string to a first rotational direction or a second rotational direction, as illustrated by box 505.

The method can involve instructing the processor to increase a speed of rotation of the drill pipe to orient the drill string to a user selected position, as illustrated by box 507.

The method can involve setting the brake of the top drive using a brake set and release means, as illustrated by box 509.

The method can involve using the rotational selection means for selecting rotation of the drill string to stop pipe drill pipe rotations, as illustrated by box 511.

The method can involve displaying drill string speed and torque continuously to a user while operating the top drive in orient mode, as illustrated by box 613.

While these embodiments have been described with emphasis on the embodiments, it should be understood that within the scope of the appended claims, the embodiments might be practiced other than as specifically described herein.

What is claimed is:

1. A drilling rig for automatically executing rocking of a drill string, wherein the drilling rig comprises:

a. a top drive connected to a drill string supported by a hoist of a drill tower;

b. hydraulic pumping means connected to the top drive;

c. a prime mover connected to the hydraulic pumping means;

d. a control system connected to the top drive, hydraulic pumping means and prime mover, wherein the control system comprises:

(i) at least one processor;

(ii) data storage connected to the at least one processor;

(iii) a torque pin sensor connected to the at least one processor and mounted between the top drive and a torque track slide assembly for moving the top drive;

(iv) a speed sensor connected to at least one of the processors and mounted integrally within the top drive;

e. a remote control connected to the processor, enabling a user to remotely perform at least one of four modes of operations at least partially automatically using the drill string by the top drive comprising a drill mode, a make-up mode, an orient mode, and a rocking mode, and wherein the remote control comprises:

(i) a torque control and monitoring means comprising:

1. a right hand torque and left hand torque display connected to the torque pin sensor for displaying simultaneously and in real time right hand torque pressure and left hand torque pressure applied to the drill string by a member of the group, comprising:

a. the top drive;

b. a mud motor; and c. combinations thereof;

2. a torque release actuator;

3. a drill torque control connected to the hydraulic pumping means;

4. a make-up torque control connected to the processor; and 5. a mode of operation selection means;

(ii) a speed control and monitoring means comprising:

1. a speed display in revolutions per minute connected to the speed sensor for displaying revolutions per minute applied to the drill string in real time by the top drive;

2. a speed selection means connected to at least one of the processors; and 3. a rotational selection means to control rotation of the drill string wherein the rotational selection means allows a rotational direction to be selected, wherein the rotational direction comprises a clockwise rotation, a counter-clockwise rotation, and stop;

f. computer instructions in the data storage to compare data from the torque pin sensor to a top drive torque maximum or a specified number of turns for the drill string to rock the drill string;

g. computer instructions in the data storage for establishing a maximum torque while drilling in a clockwise direction or a specified number of turns for the drill string in a clockwise direction; and h. computer instructions in the data storage for establishing a maximum torque while rotating the drill string in a counter-clockwise direction or a specified number of turns for the drill string in a counter-clockwise direction.

2. The drilling rig for automatically executing rocking of a drill string of claim 1, wherein the remote control has a grabber control, wherein the grabber control is connected to at least one of the processors and a grabber of the top drive, the grabber control comprising:

a. a grabber closed indicator;

b. an open and grab switch; and c. an up and down switch electrically connected to an up and down hydraulic means on the top drive;

d. computer instructions in the data storage to operate the grabber to automatically close the grabber to grab wellbore equipment of wellbore operations; and to open the grabber when the open and grab switch is actuated from the remote control;

(i) computer instructions for automatically moving the grabber up or down along the drill string using the top drive, when the up and down switch is actuated;

(ii) computer instructions for turning on the grabber closed indicator when the grabber is in a closed position; and (iii) computer instructions for automatically floating the grabber when the grabber is engaged on the drill string.

3. The drilling rig for automatically executing rocking of a drill string of claim 1, wherein the remote control further comprises:

a. a blowout preventer opening and closing means connected to a valved inside blow out preventer (IBOP); and b. the data storage further includes:

(i) computer instructions in the data storage for automatically opening the IBOP with the top drive; automatically closing the IBOP with the top drive when actuated by the means for opening and closing the blow out preventer; and (ii) computer instructions in the data storage for preventing the operation of the IBOP if any rotation is detected on the drill string.

4. The drilling rig for automatically executing rocking of a drill string of claim 1, wherein the remote control further comprises: a brake set and release means connected to a brake of the top drive to stop rotation of the top drive; and wherein the data storage comprises computer instructions for automatically setting the brake of the top drive; and computer instructions in the data storage for automatically releasing the brake of the top drive depending on the commands from the brake set and release means.

5. The drilling rig for automatically executing rocking of a drill string of claim 4, wherein the remote control further comprises a prime mover control comprising:

(i) a prime mover is off indicator light connected to the processor;

(ii) an emergency kill switch for the prime mover connected to the processor and the prime mover; and (iii) a remote start/run means for the prime mover comprising:

1. a start actuation;
2. a run actuation; and
3. a kill actuation and wherein prime mover control communicates with the processor and the data storage further comprises:
   a. computer instructions for providing an automatic emergency kill sequence consisting of:
      i. stopping the prime mover;
      ii. setting the brake of the top drive, and
      iii. locking the drill string from turning; and
   b. computer instructions for providing an automatic start, run, and kill sequence comprising:
      i. starting the prime mover;
      ii. running the prime mover;
      iii. killing the prime mover;
      iv. setting the brake of the top drive; and
      v. locking the drill string from turning.

6. The drilling rig for automatically executing rocking of a drill string of claim 4, wherein the remote control further comprises:

a. a low hydraulic oil warning indicator connected to a hydraulic oil level sensor on a hydraulic tank;

b. a low hydraulic oil shutdown indicator in communication with the processor to actuate computer instructions in the data storage to automatically shut down the prime mover and the hydraulic pumping means on the top drive, and to automatically actuate the brake to stop the drill string from turning;

c. computer instructions in the data storage for turning on the low hydraulic oil warning indicator when the hydraulic oil level sensor detects a hydraulic oil level below a preset level; and d. computer instructions in the data storage to automatically prevent the operation of the prime mover and operation of the hydraulic pumping means when the hydraulic oil level sensor detects a hydraulic oil level below a preset level.

7. The drilling rig for automatically executing rocking of a drill string of claim 4, wherein the remote control further communicates with a charge pressure sensor and a servo pressure sensor and the remote control comprises:

a. a first hydraulic oil low pressure warning indicator that communicates with a hydraulic charge pressure sensor, located in a pressurized hydraulic charge line for the hydraulic pumping means and further wherein the hydraulic oil low pressure warning indicator operates with computer instructions to compare oil pressures to preset level, actuate the warning indicator and to automatically shut down the prime mover and hydraulic pumping means when the charge pressure drops below a preset limit and set the brake on the top drive; and b. a second hydraulic oil low pressure warning indicator that communicates with the servo pressure sensor, located in a pressurized hydraulic servo line for the hydraulic pumping means, and further wherein the hydraulic oil low pressure warning indicator operates with computer instructions to automatically shut down the prime mover and hydraulic pumping means when the servo pressure drops below a preset limit, and set the brake on the top drive.

8. The drilling rig for automatically executing rocking of a drill string of claim 4, wherein the remote control further comprises:

a. a no cool oil circulation indicator connected to the processor, and a cool oil circulation sensor on the top drive; and b. computer instructions in the data storage for detecting cool oil flow, and then automatically shutting down the main hydraulic pumping means, and the prime mover when no cool oil flow is detected by the cool oil circulation sensor and set the brake of the top drive.

9. The drilling rig for automatically executing rocking of a drill string of claim 1, wherein the remote control further comprising:

(i) an out, hold, and back switch in communication with an electric/hydraulic kick-out solenoid on the top drive, wherein the kick-out solenoid provides bidirectional hydraulic fluid flow to at least one hydraulic cylinder and further wherein the at least one hydraulic cylinder moves at least one elevator link, of an elevator kick-out of the top drive to an extended or into a retracted position; and (ii) a float control and indicator connected to a float solenoid which overrides the at least one hydraulic cylinder to allow for floating and centering of a drill pipe for making up into a drill string.

10. The drilling rig for automatically executing rocking of a drill string of claim 1, wherein the remote control further comprises:

a. a hydraulic oil temperature warning indicator connected to the processor and to the hydraulic oil temperature transducer on the top drive and to the prime mover of the top drive; and b. a hydraulic oil temperature shutdown indicator connected to a hydraulic oil temperature transducer on the top drive; and further wherein the hydraulic oil temperature transducer communicates with:

(i) computer instructions in the data storage to engage the hydraulic oil temperature warning indicator and limit prime mover speed when the hydraulic oil temperature exceeds 160 degrees Fahrenheit; and (ii) computer instructions in the data storage to automatically activate the hydraulic shut down warning indicator for the shutting down of the hydraulic pumping means and the prime mover, and setting the brake when the hydraulic oil temperature exceeds a preset maximum of 170 degrees Fahrenheit.

11. The drilling rig for automatically executing rocking of a drill string of claim 1, wherein the mode of operation selection means, further includes indicator lights for each of the modes of operation selected from the group consisting of: drilling, make-up, orient, and rocking, and wherein each light is a drill mode light, a make-up mode light, an orient mode light, or a rocking mode light; and wherein each mode light connects to the processor and to computer instructions in the data storage wherein the computer instructions prevent the mode lights from glowing if a sequence of predefined operational steps have not occurred.

12. The drilling rig for automatically executing rocking of a drill string of claim 11, further comprising in the data storage:

a. computer instructions for operating the top drive in a drilling mode wherein the top drive operates at a 100 percent maximum drill torque and an 80 percent maximum hydraulic pumping means displacement;

b. computer instructions for operating the top drive in an orient mode for orienting a drill bit attached to a drill string supported by the top drive, wherein the top drive operates at a 100 percent maximum drill torque and an 80 percent maximum hydraulic pumping means displacement; and c. computer instructions for operating the top drive in a make-up drill pipe mode, wherein the top drive operates at a 100 percent maximum make-up torque and a 33 percent maximum hydraulic pumping means displacement.

13. The drilling rig for automatically executing rocking of a drill string of claim 1, further comprising computer instructions for operating the top drive in rocking mode, wherein the top drive operates at a 38 percent maximum torque and a 33 percent maximum hydraulic pumping means displacement.

14. A method for rocking a drill string using a drilling rig with grabber, top drive with brake, torque controls, and a control system with a processor, data storage and a remote control, wherein the method comprises:

a. using computer instructions in data storage of the control system of the top drive to instruct the processor to initiate rock mode;

b. using computer instructions to automatically increase a speed of the prime mover to a preset prime mover limit;

c. using a make-up torque control and a torque control, both a right hand rock torque applied to the drill string is reduced to zero and a left hand rock torque applied to the drill string is reduced to zero;

d. using computer instructions to limit the right hand torque and the left hand torque to a preset torque percentage that is less than 100 percent torque on the drill string;

e. using a rotational selection means to control a rotation of the drill string to change rotation of the top drive from stop to a first directional rotation;

f. using a first torque control to increase torque pressure in the first rotational direction and increase hydraulic fluid flow from hydraulic pumping means to a hydraulic motor of the top drive to establish a maximum torque pressure or a specified number of turns for the top drive in the first rotational direction;

g. using the means for selecting rotation of the drill string to stop pipe drill pipe rotation;

h. using the means for selecting rotation of the drill string to start rotation of the drill pipe in a second rotational direction;

i. using a second torque control to increase torque pressure in the second rotational direction and increase hydraulic fluid flow from hydraulic pumping means to a hydraulic motor of the top drive to establish a maximum torque pressure or a specified number of turns for the top drive in the second rotational direction;

j. using the means for selecting rotation of the drill string to stop pipe drill pipe rotations;

k. adjusting the speed of the drill string using a speed selection means simultaneously while rotating the drill pipe in the first or second rotational direction; adjusting right hand torque on the drill string while rotating the drill string in the first or second rotational direction, adjusting left hand torque on the drill string while rotating the drill string in the first or second rotational direction, or combinations thereof;

l. using computer instructions that increase hydraulic fluid flow from the hydraulic pumping means to the established maximum torque pressure or specified number of turns for the top drive in the first rotational direction;

m. using computer instructions to verify that the drill pipe has stopped rotating in the first rotational direction and then change rotation from stop to a second directional rotation;

n. using computer instructions that increase hydraulic fluid flow from the hydraulic pumping means to the established maximum torque pressure or specified number of turns for the top drive in the second rotational direction as;

o. using computer instructions to verify that the drill pipe has stopped rotating in the second rotational direction and then change rotation from stop to the first directional rotation;

p. using computer instructions to repeat the changing of rotational directions for as long as indicated by a user; and q. using computer instructions to display drill string speed and right hand torque and left hand torque on the drill string continuously to a user while operating the top drive in rocking mode.

15. The method of claim 14, comprising using computer instructions to adjust a speed of the drill string while using computer instructions simultaneously.

16. A method for drilling using a drilling rig with grabber, a top drive with brake and a control system with a processor, data storage and remote control, wherein the method comprises:

a. using computer instructions in data storage of the control system of the top drive to instruct the processor to initiate drill mode;

b. using a rotational selection means for controlling a rotation of the drill string to a first rotational direction or a second rotational direction; and c. using a speed selection means to increase speed of turning of the drill string in the selection rotational direction;

d. using computer instructions to limit torque pressure while drilling to a desired maximum pressure; and e. using computer instructions to display drill string speed and torque continuously to a user while operating the top drive, wherein the torque is measured using a torque pin sensor connected with the processor and mounted between the top drive and a torque track slide assembly.

17. A method for rotating a drill string for making up drill pipe using a drilling rig with grabber, top drive with brake and a control system with a processor, data storage and a remote control, wherein the method comprises:

a. using computer instructions in data storage of the control system of the top drive to instruct the processor to initiate make-up mode;

b. using computer instructions in data storage of the control system of the top drive to instruct the processor to grab drill pipe with the grabber;

c. using a rotational selection means to control rotation of the drill string to select a rotation of the top drive;

d. using computer instructions in data storage of the control system of the top drive to instruct the processor to set a speed of rotation of the drill pipe to a maximum speed;

e. increasing the speed of rotation by at least 10 percent using a speed selection means; step until the pipe breaks out or makes up as step; and f. releasing the drill pipe with the grabber as step.

18. A method for orienting a drill string in a wellbore using a drilling rig with grabber, top drive with brake and a control system with a processor, data storage and a remote control, wherein the method comprises:

a. using computer instructions in data storage of the control system of the top drive to instruct the processor to initiate orient mode;

b. using computer instructions in the data storage of the control system to limit rotation of the drill string to no more than 10 percent of maximum revolutions per minute of the top drive;

c. using a rotational selection means to control rotation of the drill string to a first rotational direction or a second rotational direction;

d. using computer instructions in data storage of the control system of the top drive to instruct the processor to increase a speed of rotation of the drill pipe to a orient the drill string to a user selected position;

e. setting the brake of the top drive using a brake set and release; and f. using the rotational selection means to control rotation of the drill string to stop drill string rotations.

19. An automated method for setting torque for drilling mode of a top drive for a drill string running into a wellbore using a drilling rig with grabber, top drive with brake and a control system with a processor, data storage and a remote control, wherein the method comprises:

a. using computer instructions in data storage of the control system of the top drive to instruct the processor to stop rotation of the drill string;

b. using computer instructions in data storage of the control system of the top drive to instruct the processor to release the brake of the top drive;

c. using computer instructions in data storage of the control system of the top drive to instruct the processor to set speed of rotation to a minimum speed;

d. using computer instructions in data storage of the control system of the top drive to instruct the processor to set the grabber to grab the drill string;

e. using computer instructions in data storage of the control system of the top drive to instruct the processor to set the mode of operation to drill mode;

f. using computer instructions in data storage of the control system of the top drive to instruct the processor to set drill torque pressure to a minimum setting;

g. using computer instructions in data storage of the control system of the top drive to instruct the processor to change a preset maximum torque value for drilling in the data storage to zero;

h. using computer instructions in data storage of the control system of the top drive to instruct the processor to start turning the drill string in a clockwise rotational direction;

i. using computer instructions in data storage of the control system of the top drive to instruct the processor to increase speed of rotation of the drill string by at least 10 percent;

j. using computer instructions in data storage of the control system of the top drive to instruct the processor to increase torque pressure while drilling to a desired maximum pressure;

k. using computer instructions in data storage of the control system of the top drive to instruct the processor to decrease speed of rotation of the drill string in rpm to zero;

l. using computer instructions in data storage of the control system of the top drive to instruct a processor to stop drill string rotation;

m. using computer instructions in data storage of the control system of the top drive to instruct the processor to set a grabber position to open;

n. using computer instructions in data storage of the control system of the top drive to limit torque pressure while drilling to a desired maximum pressure; and o. using computer instructions in data storage of the control system of the top drive to display drill string speed and right and torque and left hand torque on the drill string continuously to a user while operating the top drive in drilling mode.

20. An automated method for setting torque for make-up mode of a top drive for a drill string running into a wellbore using a drilling rig with grabber, top drive with brake and a control system with a processor, data storage and a remote control, wherein the method comprises:

a. using computer instructions to set torque for make-up mode;

b. using computer instructions to instruct the processor to stop rotation of the drill string;

c. using computer instructions to release the brake of the top drive;

d. using computer instructions to set speed of rotation of the top drive to a minimum speed of rotation;

e. using computer instructions to instruct the processor to grab drill pipe with the grabber;

f. using computer instructions to operate the top drive in make-up mode;

g. using computer instructions to set make-up torque pressure to minimum, and then using computer instructions to change a preset maximum torque value in the data storage to zero;

h. using computer instructions (i) to rotate the drill string in a clockwise rotational direction; (ii) to increase the speed of rotation by at least 10 percent; (iii) to increase torque pressure to a desired maximum; (iv) to decrease drill pipe rotation speed to zero; (v) to verify rotation of the drill pipe has stopped and to open the grabber; and i. using computer instructions to display drill string speed and torque continuously to a user while orienting the top drive.

* * * * *